United States Patent [19]

Karasko

[11] 4,035,653

[45] July 12, 1977

[54] X-RAY IDENTIFICATION TAG

[76] Inventor: Robert Karasko, 54 Lenox Ave., Yardville, N.J. 08620

[21] Appl. No.: 675,427

[22] Filed: Apr. 9, 1976

Related U.S. Application Data

[63] Continuation-in-part of Ser. No. 431,756, Jan. 8, 1974, abandoned, and a continuation-in-part of Ser. No. 484,057, June 28, 1974, which is a continuation-in-part of said Ser. No. 431,756.

[51] Int. Cl.[2] ..... H05G 1/28

[52] U.S. Cl. ..... 250/475; 250/476

[58] Field of Search ..... 250/476, 475

[56] References Cited

U.S. PATENT DOCUMENTS

| | | | |
|---|---|---|---|
| 2,257,933 | 10/1941 | Belknap | 250/476 |
| 2,939,958 | 6/1960 | Anderson | 250/476 |
| 3,518,428 | 6/1970 | Ring | 250/476 |
| 3,668,394 | 6/1972 | Panzer | 250/476 |
| 3,828,454 | 8/1974 | Hafner | 40/27 |

*Primary Examiner*—Craig E. Church

*Attorney, Agent, or Firm*—Albert Sperry; Frederick A. Zoda; John J. Kane

[57] ABSTRACT

An identification tag adapted to be employed in making X-ray pictures is provided with a plastic base having reinforcing means which are relatively transparent to X-rays embedded therein and defining an opening through which X-rays freely pass. One or more symbols such as letters, numbers or the like formed of material which is substantially opaque to X-rays are positioned in the opening in the reinforcing material and embedded in the plastic body of the tag.

2 Claims, 8 Drawing Figures

X-RAY IDENTIFICATION TAG

This application is a continuation-in-part of application Ser. No. 431,756 filed Jan. 8, 1974, now abandoned, and of Ser. No. 484,057 filed June 28, 1974, now copending, which is a continuation-in-part of Ser. No. 431,756.

FIELD OF THE INVENTION

In making X-ray pictures it is usual practice to place an identification tag over the photographic plate to cause the name of the patient or doctor and the character of the X-ray picture being produced to appear on the photograph itself. For this purpose one or more tags bearing symbols formed of X-ray opaque material such as lead or the like are provided for placement on or over the photographic plate or film. Typical identification tags of this general type are disclosed in U.S. Pat. Nos. 2,018,175 and 3,518,428. An improved form of X-ray identification tag is shown and described in the present inventor's copending application Ser. No. 431,756 filed June 28, 1974 now abandoned.

It is found that those identification tags which are formed of metal or have a metal backing often become bent or twisted so that they cannot be firmly secured in place on the photographic plate and do not render a well resolved notation. On the other hand, in the manufacture of an identification tag having a plastic base, it is usual to form cavities or openings in the plastic material defining the letter or symbol and to fill such cavities or openings with powdered lead on other X-ray opaque material. However, plastic identification tags are readily broken when given rough usage with the result that the lead powder, which is highly toxic, may be exposed and scattered about so as to endanger the user.

All prior identification tags have tended to cause diffusion of X-rays passing therethrough with the result that the symbols appearing on the photographs are often blurred and indistinct. Moreover, when "soft" X-rays of limited intensity are used, as when taking X-ray photographs of children or delicate tissues, when the radiation is of relatively short duration, and when the X-rays are not emitted from an exactly vertical direction, the limited exposure of the film may render the identification appearing on the picture quite pale and indistinct.

THE PRESENT INVENTION

In accordance with the present invention X-ray identification tags are provided which are strong and durable and which serve to produce more clear and readily readable images on the X-ray photographs. These results are attained by embedding in the plastic body of the tag a reinforcing element or means formed of material which is relatively transparent to X-rays. The reinforcing means preferably is formed with an opening therein through which the X-rays may travel freely without absorption. The X-ray opaque symbol is then located within the opening in the reinforcing means and embedded in the plastic material so as to be firmly and permanently secured in place. In some instances, the symbol may take the form of an opening or passage through a body of X-ray opaque material embedded in the plastic of the tag whereby the symbol will appear on the finished photograph as a dark exposed symbol surrounded by the transparent unexposed area of the photograph. Thus, the symbol may appear either as a positive or a negative on the finished photograph depending on the manner in which the X-ray absorbing portion of the tag is formed.

It is also believed that the use of metallic reinforcing member having but little X-ray absorbing ability will nevertheless serve to absorb stray X-rays so as to produce a more sharply defined symbol on the X-ray photograph reducing the blurring in outline resulting when using identification tags of the prior art. Further, if desired the X-ray opaque symbol may embody two or more layers composed of different metals in which case the scattering of X-rays is reduced or the scattered rays are absorbed so as to provide a more sharply defined symbol representative on the finished X-ray photograph. Also when X-rays are not emitted perpendicular with respect to the identification plate, a tapered or truncated symbol configuration may be desirable to produce a well defined notation.

THE DRAWINGS

Figure 2:
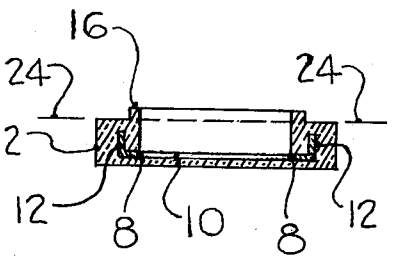
FIG. 2 is a transverse sectional view of the base shown in FIG. 1.
Figure 1:
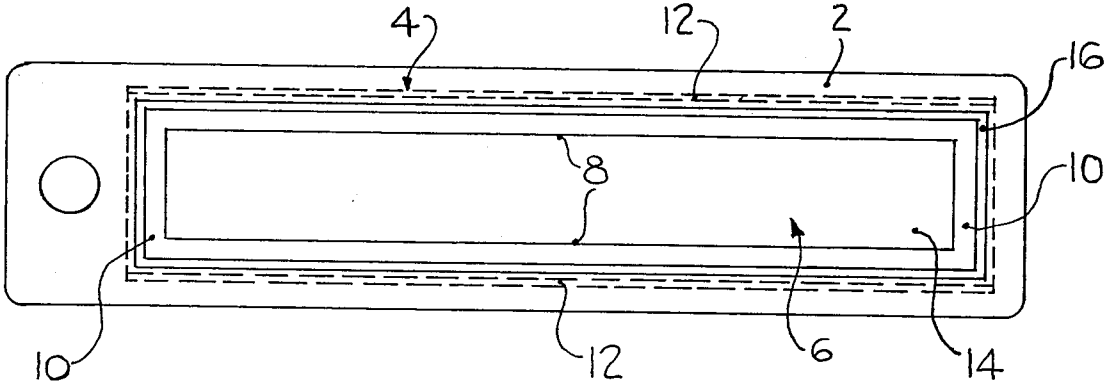
FIG. 1 is a plan view of an embodiment of the present invention showing the base employed in producing one form of identification tag.

In that form of the invention chosen for purposes of illustration in FIGS. 1 to 4, the tag has a body 2 made of plastic material which is transparent to X-rays as for example an acrylic resin or the like which is adapted to be molded and machined readily. Reinforcing means 4 are embedded in the plastic body and preferably are generally rectangular in shape so as to present a central unobstructed opening 6 between opposite side portions 8 and end connecting portions 10. The side portions 8 of the reinforcing means 4 may be right angular in cross-section so as to present side flanges 12 which serve to strengthen the reinforcing means and the body 2 of the plastic body of the tag to resist bending of the tag. The reinforcing means 4 is preferably formed of a metal that is relatively transparent to X-rays. Thus, aluminum, rolled steel, copper and other metals having an atomic number less than about 50 may be used in forming the reinforcing means.

The body 2 of the tag is initially formed with a cavity 14 therein within which X-ray opaque symbols may be positioned. As initially formed the body 2 has an upstanding rim 16 surrounding the cavity 14 which may subsequently be removed in producing the finished tag. The X-ray opaque symbols 18 may be separately formed of lead or other material having a relatively high atomic number. As described in the above copending applications, they may be cast or forged and if desired they may be connected together by a wire or the like to facilitate placement thereof in the cavity 14 of the base.

Figure 3:
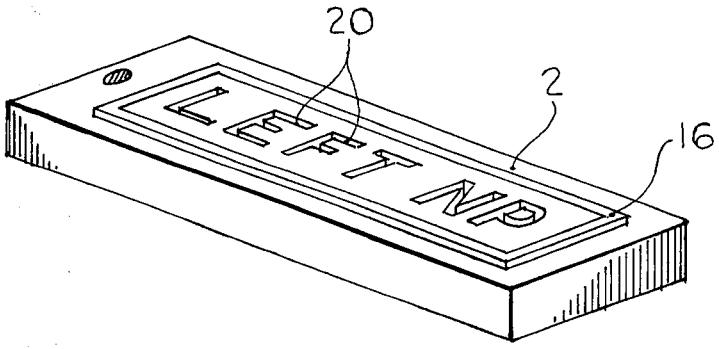
FIG. 3 is a perspective view of the base shown in FIGS. 1 and 2 when prepared for reception of X-ray opaque material.
Figure 4:
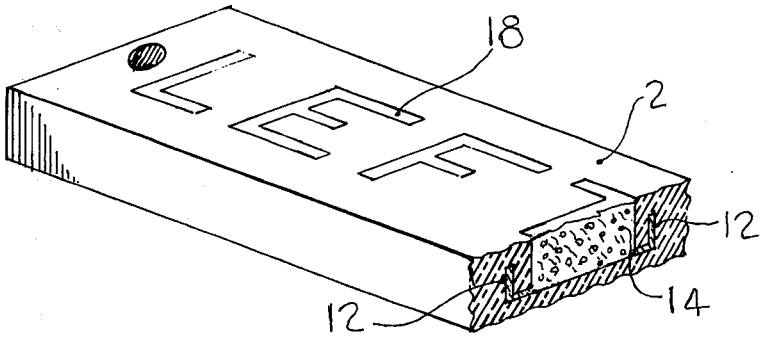
FIG. 4 is a perspective of a finished tag of the type shown in FIGS. 1, 2 and 3 with a portion thereof broken away.

In the alternative and as shown in FIG. 3, the body 2 of the tag may be formed initially of a single integral plastic member in which cavities 20 are formed or machined in the shape of the desired symbols. Thereafter, the X-ray opaque material may be filled into the symbol cavities 20 to form the X-ray opaque symbols 18. For this purpose, lead powder or the like may be mixed with a liquid acrylic resin or solution and be packed or filled into the cavities to produce a finished tag as shown in FIG. 4. Since bubbles tend to rise to the top of liquid resin as described in said copending application, the upper surface of the body 2 and the rim 16, if present, may be machined off the top of the body as represented by the line 24 of FIG. 2 to provide a smooth finished upper surface of the tag. In this connection, the use of a mixture of lead powder with a resin or plastic in forming the symbols is a great improvement over the use of lead powder mixed to a paste with water heretofore suggested. The resin holds the highly toxic lead powder in place so that it cannot be released, brushed off or scattered about due to breakage of the tag or rough handling thereof. Contamination or danger to the user and equipment is thereby precluded.

Figure 5:
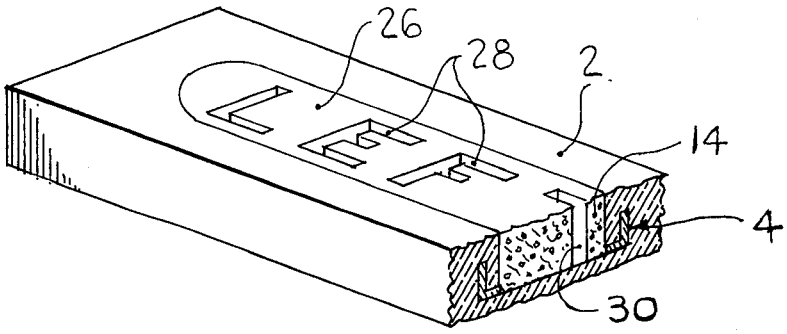
FIG. 5 is a perspective view of an embodiment of the present invention illustrating an unfinished identification tag of an alternative type.

In some instances, it is desirable to form the identification tag so as to present the symbols on the photographic film in a positive rather than negative form. For this purpose shown in FIG. 5, the body 2 of the tag may be formed with a central cavity 14 which is filled with a mass of X-ray opaque material such as a mixture of plastic and lead powder indicated at 26. The symbols may then be machined or otherwise formed in the mass 26 of X-ray opaque material provided passages or X-ray transparent zones 28 in the shape of the symbols desired. The symbols will thus appear on the photographic plate as positive exposed symbols surrounded by a negative area or background. Such symbols often tend to appear more prominently on the X-ray picture. Further, if desired and as shown in FIG. 5, the symbol cavities 28 may be filled with X-ray transparent plastic or other material 30 of a color contrasting with that of the mass 26 forming the background so as to be readily read or visible to the operator using the tag.

Figure 6:
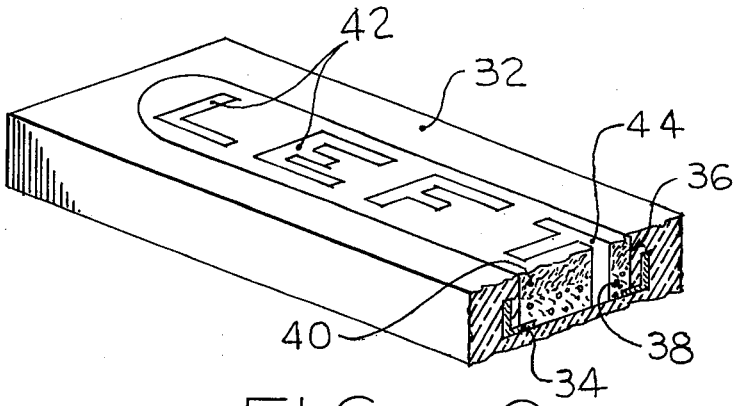
FIG. 6 illustrates a further alternative embodiment of the present invention.

In the further alternative form of the invention illustrated in FIG. 6, the body 32 of the tag is formed with a reinforcing member 34 embedded therein and extending about a central cavity in the body. The cavity 36 is filled with two superposed layers of metal admixed with plastic material as indicated at 38 and 40. The metals of these two layers are sometimes different and for example the lower layer 30 may contain lead powder while the layer 38 may contain copper or bronze powder. The symbols to be used are formed by machining out cavities 42 extending through one or both layers of the metal composition and a white or colored plastic material 44 is filled into the cavities. Thereafter, the upper surface of the body 32 may be machined off to provide a finished identification tag having a smooth polished surface in which the symbols are prominently displayed.

Figure 7:
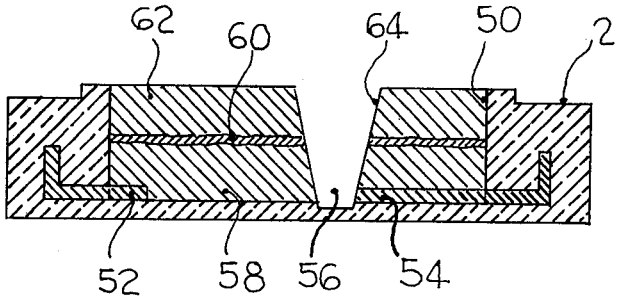
FIG. 7 is a transverse sectional view through a further alternative embodiment of the invention.

In that form of the invention illustrated in FIG. 7 the identification tag is formed with a body of molded plastic material 2 having a reinforcing member 4 embedded therein. The inner edge of the reinforcing member may extend only a short distance inward at the sides of a central cavity 50 in the base as in the construction shown in FIG. 2 and as indicated at 52 in FIG. 7. However, if desired, and as indicated at 54 in FIG. 7, the reinforcing member may extend all the way across the cavity 50 in the base and may cut out in forming the symbols in the tag as indicated at 56 in FIG. 7.

In either case, the cavity 50 within the base 2 of the tag may be provided with a lower layer of X-ray opaque material 58 such as a lead containing composition. A layer of shielding material 60 such as copper or the like may then be placed over the lower layer 58 and the cavity then may be filled with additional metallic material as indicated at 62. This arrangement of multiple layers of X-ray absorbing material has been found in practice to result in the most sharply defined symbols on X-ray photographs and to be effective with either "hard" or soft X-rays and when subjected to various different exposure durations. Further, as shown in FIG. 7 it is sometimes desirable to form the symbol defining passage 64 within the X-ray absorbing material with tapered walls inclined at an angle of from about 12° to 20° with respect to the vertical axes of the passage 64. In this way, the narrower ends of the passages will face away from the source of X-rays when the tag is in use and the sharpest definition in outline of the symbols on the X-ray picture produced is attainable. This tapered configuration is desirable to provide a fully clear opening when the X-rays are emitted from a non-perpendicular position, since a clear cross-sectional area of material is presented having little opacity to X-rays.

Figure 8:
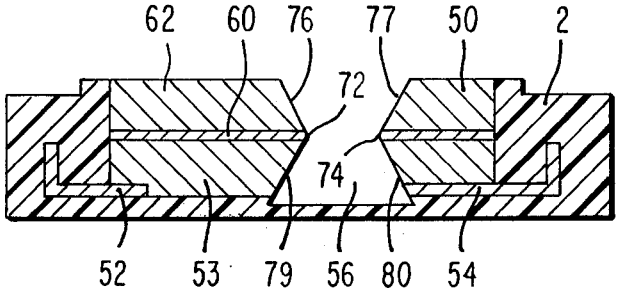
FIG. 8 is a transverse sectional view through another alternative embodiment of the invention.

FIG. 8 shows the same structure as FIG. 7 with a doubly tapered machined section 56. The width of the symbol is defined by the distance between the machined edges 72 and 74 of shielding material 60. From edges 72 and 74 the upper walls 76 and 77 of the upper layer 62 and the lower walls 79 and 80 of the lower layer 58 taper mutually outward. This tapered passage structure will allow the tag to form a well defined symbol when used with X-rays generated at an oblique angle with respect thereto. In particular, a well-defined symbol will be formed as long as the inclination angle of the approach of the X-rays with respect to the normal vertical is equal to or less than the taper of the walls 76, 77, 79 and 80 with respect to the normal vertical.

Identification tags thus produced serve to produce clear sharp symbols on the X-ray photograph in which blurring in outline due to the scattering of X-rays is practically eliminated. Moreover, the tags are strong and practically indestructable and the danger of contamination in the event a tag is broken is eliminated.

While typical and preferred embodiments of the invention and methods of producing the same have been shown in the drawings and described above, it will be apparent that numerous changes and modifications may be made in the form, construction and arrangement of the elements of the combination and in the composition thereof as well as the various steps employed in producing the same. In view thereof, it should be understood that the particular embodiments of the invention disclosed herein are intended to be illustrative only and are not intended to limit the scope of the invention.

I claim:

1. An X-ray identification tag comprising a plastic body having reinforcing means which is relatively transparent to X-rays embedded therein, said reinforcing means defining an opening through which X-rays may pass, X-ray opaque material positioned within said opening and secured to said plastic body to define passages therethrough being relatively transparent to X-rays to define any pre-chosen symbol, said passage including a minimum width point intermediate between the upper and lower surfaces of said opague material, said passage being tapered to widen in both the upward and downward directions from said minimum width point to form symbols when used with non-vertical X-rays.

2. An X-ray identification tag as defined in claim 1 wherein the taper of said passage is at least equal to the expected inclination of the incoming X-ray.

* * * * *